United States Patent [19]
Benno
[11] Patent Number: 4,596,330
[45] Date of Patent: Jun. 24, 1986

[54] MULTIPACKAGES, THE PACKAGING ELEMENTS, AND THE METHOD FOR MAKING THE MULTIPACKAGES

[76] Inventor: Edward L. Benno, 17960 W. Hwy. 120, Grayslake, Ill. 60030

[21] Appl. No.: 291,845

[22] Filed: Aug. 10, 1981

[51] Int. Cl.[4] ..... B65D 65/00
[52] U.S. Cl. ..... 206/427; 206/432; 206/497
[58] Field of Search ..... 206/427, 432, 497, 597; 229/DIG. 12

[56] References Cited

U.S. PATENT DOCUMENTS

| | | | |
|---|---|---|---|
| 3,126,680 | 3/1964 | Baird, Jr. et al. | 229/DIG. 12 |
| 3,166,878 | 1/1965 | Pepitone et al. | 229/DIG. 12 |
| 3,286,833 | 11/1966 | Chadbourne | 206/192 |
| 3,400,810 | 9/1968 | Makowski | 229/DIG. 12 |
| 3,479,788 | 11/1969 | Dreyfus | 229/DIG. 12 |
| 3,695,426 | 10/1972 | Engelsberger | 206/597 |
| 3,948,392 | 4/1976 | Faust | 206/497 |
| 3,986,611 | 10/1976 | Dreher | 206/597 |
| 4,300,681 | 11/1981 | Klygis et al. | 206/428 |
| 4,304,332 | 12/1981 | Danti | 206/597 |

*Primary Examiner*—Joseph Man-Fu Moy
*Assistant Examiner*—David Fidei
*Attorney, Agent, or Firm*—Edward L. Benno

[57] ABSTRACT

Multipackages, packaging elements, and the method for making the multipackages wherein the containers of the multipackages are primarily containers having a generally cylindrical shape such as commonly used beverage bottles and cans and wherein the containers are arranged in the well known six or eight pack configurations. The package making elements are a pair of circumferentially continuous bands made from elastic plastic film materials capable of being highly stretched below the elastic limits thereof. The bands are applied in a highly tensioned condition, as opposed to known shrink film arrangements, about the group of containers with the axis of one band disposed vertically and with the axis of the other band disposed horizontally and longitudinally of the group to make a stable package capable of being carried by a person grasping the upper portion of the band arranged with its axis disposed horizontally.

11 Claims, 8 Drawing Figures

MULTIPACKAGES, THE PACKAGING ELEMENTS, AND THE METHOD FOR MAKING THE MULTIPACKAGES

BACKGROUND OF THE INVENTION

Six packs of beverage products in bottles and cans have been made in the prior art by many different arrangements. The general commercial requirements for such packages are that the package be esthetically pleasing, stable and capable of being handled in normal store or supermarket marketing procedures, and capable of being easily carried and used by a person purchasing such packages. If the cost of making the multipackage is of little or no importance the prior art includes a great many multipackaging arrangements which would satisfy general commercial requirements. However, the cost of such multipackages is, more often than not, of paramount importance in the beverage multipackaging industry. As material and energy costs have increased, the problem of making such multipackages has become more and more complicated. The advent of plastic beverage bottles has also raised new questions relative to the making of commercially acceptable multipackages.

Blown plastic film materials have for a considerable period of time appeared to offer the desired economics for beverage multipackages and many attempts have been made to wrap or band a group of beverage containers with film materials. One somewhat successful arrangement has involved loosely applying a film band about a group of containers, then heating the film to cause it to melt against and about the container group, and then cooling the film back to its crystalline state. In such an arrangement the necessary use of heat energy can represent a substantial commercial disadvantage.

Other known arrangements have involved banding procedures where the film is in a stretched condition about the container group. Generally, those arrangements have involved small degrees of stretching with fillers, dividers, or handles being used to secure the necessary package integrity.

Highly stretched plastic film band multipackages appear to have been unsuccessful for a number of reasons. Firstly, the packaging art has lacked equipment or machines capable of applying a highly stretched film band in a greatly tensioned condition about a container group. Secondly, in the multipackaging of cylindrical containers with a broad highly tensioned film band disposed horizontally about the body portions of the container group there is a great tendency of the group to be rolled or slid from the desireable rectangular pattern into a diamond pattern or a generally circular pattern by the forces of the tensioned film band. The additional application of rigid dividers, handles or other elements has been tried to stabilize the package, but unless the additional elements have been secured to the end pairs of containers in addition to the center pair, carrying of the package by the center pair of containers has been unadvisable.

SUMMARY OF THE INVENTION

The primary object of the present invention is to make multipackages of six or eight generally cylindrical bottles or cans arranged in a rectangular pattern of two rows and perpendicular ranks using no packaging elements other than two circumferentially continuous highly stretched plastics material film bands, and in which one of the package forming bands further functions as a comfortable package carrying handle.

The making of packages of the invention is rendered feasible by using equipment and machinery according to the teachings of pending U.S. application Ser. No. 241,358 filed Mar. 6, 1981.

The two film bands of the invention are made as circumferentially continuous bands preferably made from plastics film materials which are capable of being highly stretched at ambient temperatures below the elastic limits thereof and which thereafter exhibit high recovery rates and which will for a considerable time thereafter maintain a highly tensioned condition. Such film materials are known to those skilled in the plastics materials art and include for example, blown low density polyethylene film materials having film thickness from about 1 mil to about 4 mil. The film property of being capable of a high degree of stretch is dependent upon the material formulation and method of manufacture of the film. In experiments and reductions to practice of the present invention, commercially available blown low density polyethylene film was used and a high degree of stretch appeared generally above 20% and below 50% elongation of the film. The film property of a high recovery rate is also dependent upon the material formulation and is that property which causes the film to substantially immediately return toward the initial unstretched condition upon being released from a stretched condition. The film property of maintaining a highly tensioned condition in a stretched application of the film about an object is known as creep resistance, and again is dependent upon the film formulation. A film of low creep resistance will relax or lose its compressive strength over relatively short periods of time. In practicing the subject invention a film material having sufficient creep resistance to maintain package integrity over the expected life of the package should be selected.

Although a number of embodiments of the invention are shown in the drawings, a brief summary is best made by referring to FIGS. 1-3. Six bottles arranged in the familiar six pack configuration are provided. In reductions to practice those bottles were glass with a plastic coating about the body portions thereof. Further early experiments have indicated that with the newly commerically available plastic beverage bottles the resulting packages appear to have high package integrity for the normally expected commercial handling and use of such packages.

In practicing the invention two circumferentially continuous elastic plastics film material bands are provided. The first band, which is applied about the body portions of the entire group of bottles, is made with an axial length approximating the height of the body portions of the bottles, and with an initial circumferential dimension at least 20% less than the maximum circumferential dimension measured horizontally about the body portions of the group of bottles aligned in the rectangular six pack configuration, but not so small that the elastic limits of the film material are exceeded when the band is stretched and applied about the group of bottles as shown in FIGS. 1-3. In the method of the invention the first band must be applied before the second band is applied. In reductions to practice of the invention it has been found that before the second band is applied, the partially completed package is somewhat unstable. Rough handling of the partially completed package at that point will cause the bottles, under the high compressive forces of the applied first band, to roll or slide into a diamond pattern or a circular pattern. That tendency has appeared particularly severe in the making of packages of eight bottles as shown in FIGS. 4 and 5.

Before the second band is applied, the stretched film of the first band is substantially flat in the areas where it extends from tangential contact with the end pairs of bottles across the body portions of the center pair of bottles. The second band which is applied circumferentially about the center pair of bottles as shown in FIGS. 1-3, is made with an axial length approximating the distance between the body portions of the end pairs of bottles. In the six pack of FIGS. 1-3 that distance is substantially the maximum diameter of one of the bottles. The second band is further made with an initial circumferential dimension substantially less (20% or more) than the circumferential dimension about one pair of the bottles measured in a flat plane including the longitudinal center axes of the pair of bottles, but not so much less that the elastic limits of the film material are exceeded when the second band is stretched and applied about the center pair of bottles as shown in FIGS. 1-3. In the method of the invention, the second band is applied over the outer surface of the first band, and is positioned so that the second band is equally disposed on each side of the flat plane including the longitudinal center axes of the center pair of bottles.

In reductions to practice of the invention it has been found that application of the second band immediately renders the package stable and subject to rough handling without having the bottles roll or slid into a diamond pattern. The package structure which is believed to render the package stable is the application of the second band over the first band and the produced indentations of the first band in the areas of the first band between the tangential contacts of the first band with the end pairs of bottles and the center pair of bottles. That indentation is clearly shown in the package cross section shown in FIG. 3, and is more pronounced at the upper and lower edge portions of the first band than in the center portions thereof.

In reductions to practice of the invention it has been found that in recovery the second band assumes an inverted U-shape over the tops of the center pair of bottles. That resulting shape or configuration appears to further stabilize the package and importantly provides a convenient and comfortable carrying handle for the package. It has been found that a person need merely hook one or two fingers below and about the portion of the second band extending between the tops of the center pair of bottles and that portion of the band will gather into comfortable handle for carrying the package in a depending position from one's hand. The second band supports the center pair of bottles and through the first band also supports the end pairs of bottles.

In reductions to practice of the invention it has been found that the lower edge of the first band need not extend completely to the bottom edges of the bottles but can end therabove such as where the bases of abutting bottles diverge away from each other. It has also been found preferable that the second band have an axial length sufficient to maximize the degree of the noted indentations of the first band. It has further been found preferable that the thickness of the material of the second band be substantially greater than that of the first band. For example, if the first band has a 2-mil thickness, the second band may have a 4-mil thickness. The greater thickness of the second band appears to produce more pronounced indentations of the first band for greater package stability and to substantially increase the weight carrying abilities of the second band without undue stretching under the suspended weight load of a package being carried as described above. In addition to a greater thickness, the material of the second band may have a formulation rendering the material more stiff or less subject to deformation relative to the material of the first band.

Other objects and features of the invention will be apparent upon a perusal of the hereinafter following detailed description read in conjunction with the drawings.

DETAILED DESCRIPTION OF THE INVENTION

The multipackages, packaging elements, and the method of the invention are intended for use with generally cylindrical objects such as cans or bottles. The invention is further intended for use with such containers in groups of pairs of containers in which the number of pairs is three or four.

Figure 1:
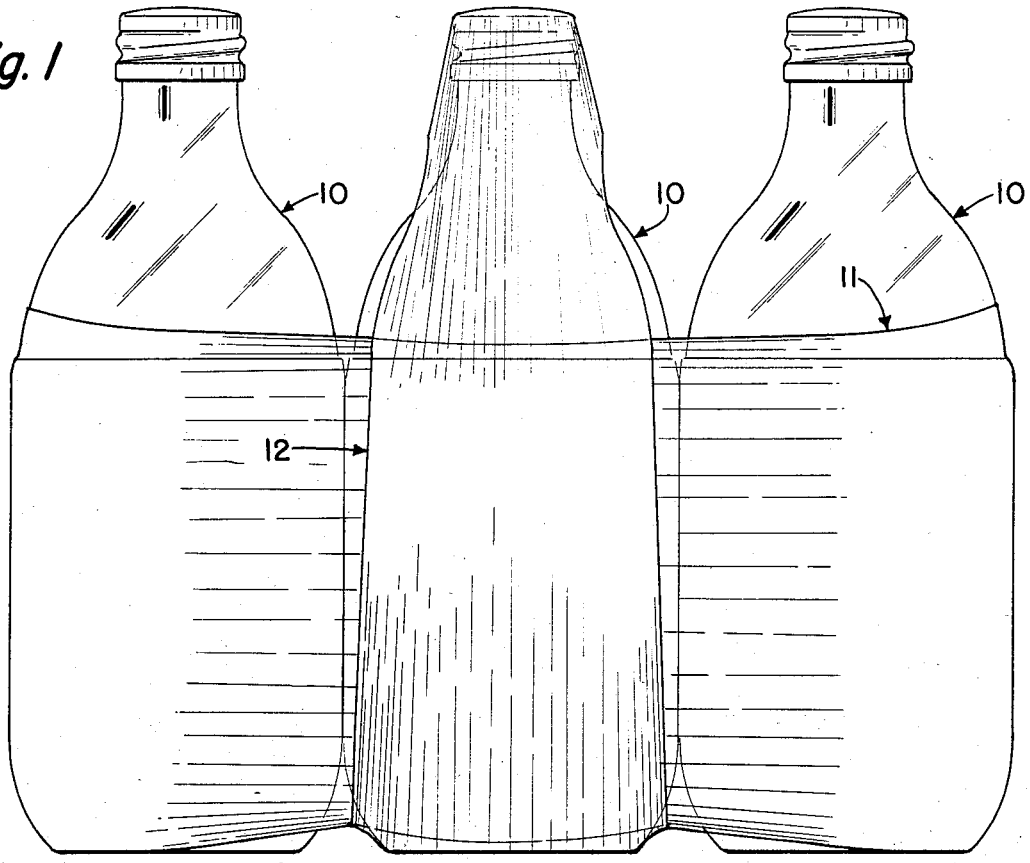
FIG. 1 is a side elevational view of one embodiment of the invention.
Figure 2:
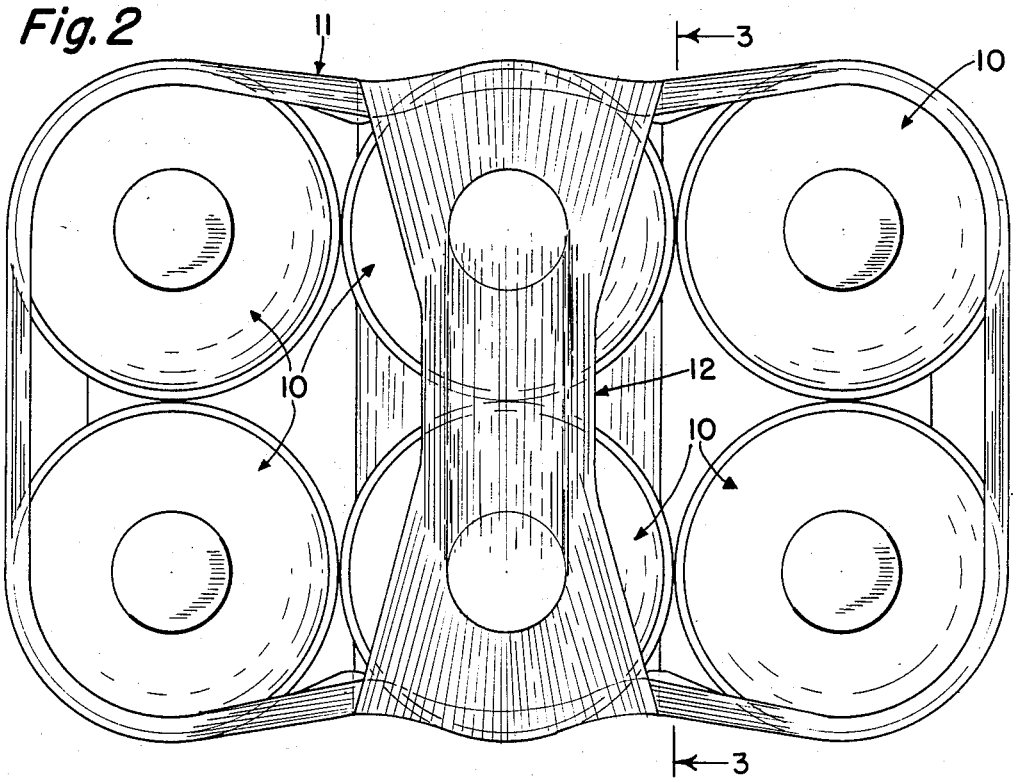
FIG. 2 is a top plan view of the structure shown in FIG. 1.
Figure 3:
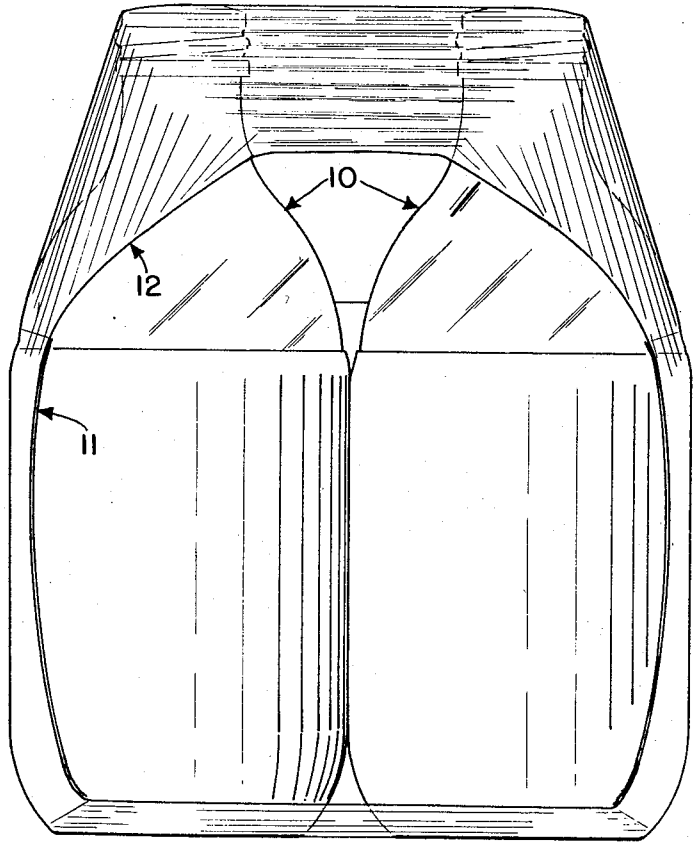
FIG. 3 is a cross sectional view of the structure of FIGS. 1 and 2 and taken substantially along the line 3—3 of FIG. 2.

As shown in the first embodiment of FIGS. 1-3, six bottles 10 are provided. Each bottle 10 has a substantially vertically extending cylindrical body portion which at its upper end merges into a neck portion that is tapered generally upwardly and inwardly to a reduced diameter cap portion. In the bottle 10 embodiment shown, the body portion of each bottle is covered by a relatively thin plastic coating or sleeve. In the alternative the bottle may be a plastics material bottle. Such bottles are commercially distributed in great numbers filled with beverages such as soft drinks.

The six bottles 10 are arranged and secured in a unitary package of a generally rectangular pattern of a row of three pairs of bottles 10 with each pair disposed transversely of the row and with the bottles 10 in a substantially abutting upstanding side-by-side relationship by two circumferentially continuous bands or tubes 11 and 12.

Tube 11 is made from an elastic plastics film material having good stretching characteristics, a high recovery rate and good creep resistance. Commercially available blown low-density polyethylene lay-flat tubing is one example of a material that has been found acceptable in practicing the invention. Good stretching characteristics have been found in films that can be stretched at ambient temperatures to a degree of at least 20% greater than their original size and somewhere approaching 50% before the elastic limits of the material are reached. It is estimated that a film material having a high recovery rate should be one that, after being initially stretched, will elastically recover against and about the bottles with at least 80% of total expected recovery within the time period that the package is made. A film material of good creep resistance is estimated as one that will not relax and lose more than about 25% of its compressive strength during the expected shelf life of the package.

The tube 11 preferably has an initial axial length of about the height of body portion of the bottles 10. Where economies of material use are important, the tube 11 can be shorter, but reductions to practice of the invention appear to indicate that the tube 11 have an initial length of at least one-half of the height of the body portion of the bottles 10.

The tube 11 has an initial circumferential dimension substantially less than the maximum circumferential dimension measured in a horizontal plane about the body portions of the group of six bottles 10 arranged in the rectangular pattern shown, and greater than a circumferential dimension which would result in the elastic limits of the material of the tube 11 being exceeded when the tube 11 is stretched and applied about the body portions of the group of six bottles arranged as shown. Experiments have appeared to indicate that the tube 11 should be stretched at least 20% from its initial dimension when using a material such as low density polyethylene film. That, and greater degrees of stretching, produces a very tight constraint or constriction between the bottles 10. To achieve that constriction it has been found necessary to use tube stretching and application apparatus such as shown in pending U.S. application Ser. No. 241,358 filed Mar. 6, 1981, because the tight constraint of the stretched film band on any other known tube stretching apparatus prevents the stretched tube from being slid or otherwise removed from the stretching apparatus and about the bottle group.

The tube 11 preferably has a material thickness as small as possible to secure commercial economies and yet ensure that the resulting package will have the necessary integrity for its intended handling and use.

In various reductions to practice, film thicknesses of from one to four mils have been found satisfactory.

Tube 12 is also made from an elastic plastics film material having good stretching characteristics, a high recovery rate, and good creep resistance.

The tube 12 preferably has an initial axial length of about the maximum diameter of one of the bottles 10. An initial axial length should be selected which will result in the vertically disposed edges of the tube 12 which engage the tube 11 being substantially midway between tangential contact of the tube 11 on the center pair of bottles 10 and tangential contact of the tube 11 on the end pairs of bottles 10 when the tube 12 is stretched and applied about the center pair of bottles 10 and the tube 11 as shown in FIGS. 1–3. That initial axial length will ensure that a maximum deflection or indentation of the tube 11 is produced between the center pair of bottles 10 and the end pairs of bottles 10 in the completed package.

The tube 12 has an initial circumferential dimension substantially less than the circumferential dimension about the center pair of bottles 10 measured in a flat plane that includes the longitudinal center axes of the center pair of bottles 10, and greater than an initial circumferential dimension which would result in the elastic limits of the material of the tube 12 being exceeded when the tube 12 is stretched and applied about the center pair of bottles 10 as shown in FIGS. 1–3. It has been found that to achieve necessary constraint of the tube 12 on the tube 11 in the completed package, the tube 12 should be stretched at least 20% in the areas thereof that extend over the cap portions of the center pair of bottles 10. The integrity of the completed package appears to increase with increased stretch in the tube 12 to the elastic limits of the tube material. Again, as with the tube 11, the necessary degree of stretch in tube 12 appears practically achievable at the present time only through the use of stretching and applicating apparatus shown in the above noted patent application.

The material thickness of the tube 12 is preferably substantially greater than that of the tube 11. Such a greater thickness appears to produce greater deflection or indentation of the tube 11, and a greater weight carrying capability of the tube 12 in the completed package.

When the tube 12 is stretched and applied about the center pair of bottles and over the outer surfaces of the tube 11 as shown, the edges of the tube 12 which are against the outer surfaces of the tube 11 cause the tube 11 in those areas to be deflected or indented toward the interior of the package, and the upper portion of the tube 12 assumes an inverted U-shape. The deflection of the tube 11 by the tube 12 is particularly shown in FIG. 3. The deflection is more pronounced at the upper and lower edges of the tube 11. That deflection in combination with the tensioned and resilient gripping forces of the tube 11 on the bottles 10 and with the tensioned and resilient gripping forces of the tube 12 on the tube 11 produces a stable multi-package of high integrity for shipping, handling and carrying of the package. In addition to producing the basic package, the tube 12 provides a comfortable and convenient handle for carrying of the package by a person. When the upper portion of the tube 12 between the cap portions of the bottles 10 is grasped by a person, the inverted U-shaped portion of the tube 12 gathers into a comfortable, secure handle for carrying the package. In the suspended carrying arrangement of the package, package stability and integrity are not reduced and in some reductions to practice appeared enhanced.

Figure 4:
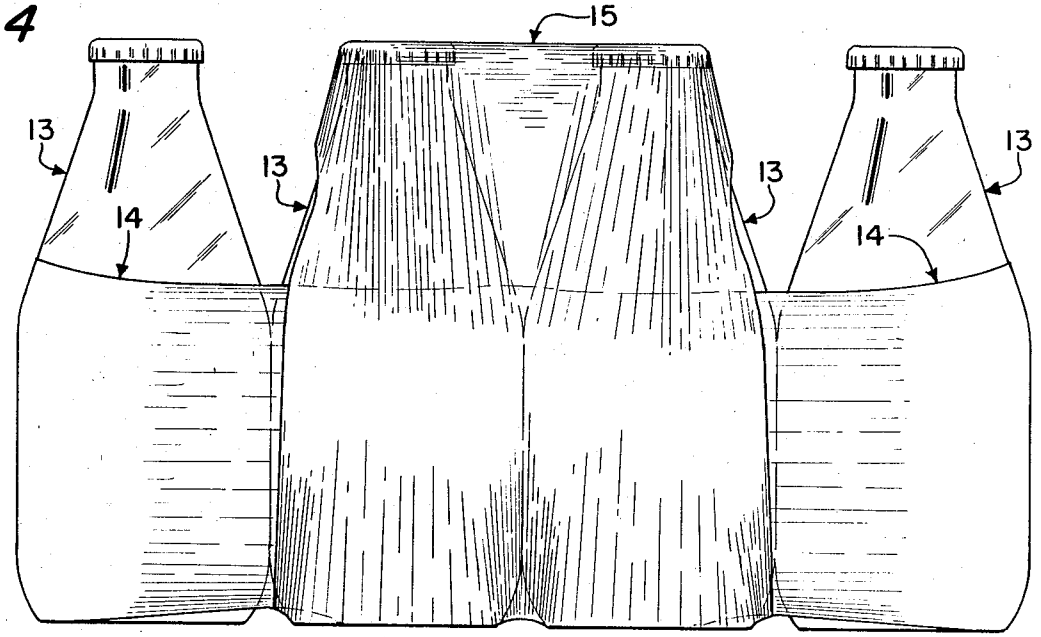
FIG. 4 is a side elevational view of another embodiment of the invention.
Figure 5:
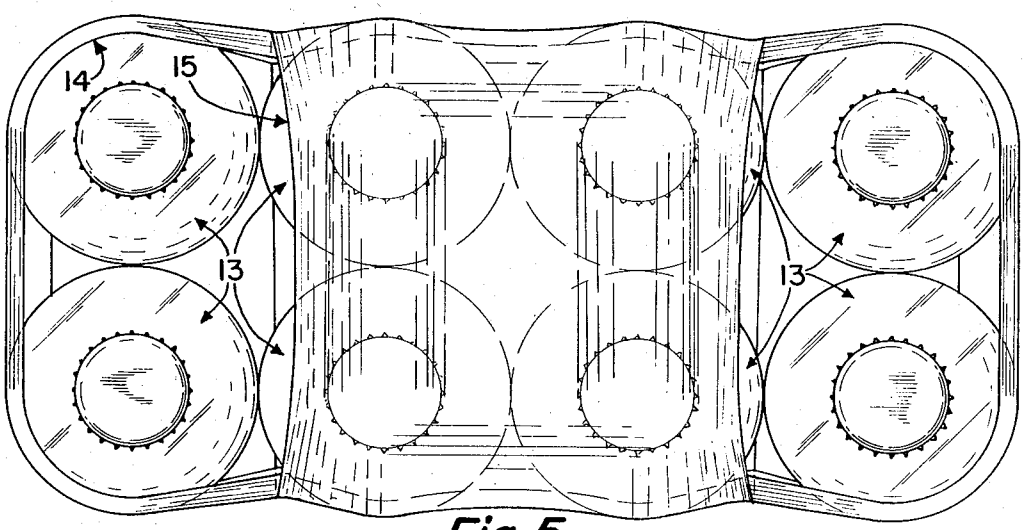
FIG. 5 is a top plan view of the structure shown in FIG. 4.

What has been said above about the details of the first embodiment of the invention shown in FIGS. 1–3 also applies to the other embodiments and need not be repeated. The embodiment of FIGS. 4 and 5 shows a package of eight bottles 13, and two tubes 14 and 15. The tube 14 is stretched and circumferentially applied about the eight bottles 13 arranged in a rectangular pattern of four pairs of bottles 13 in a row with each pair disposed transversely of the row.

The tube 15 has an initial axial length of substantially twice the maximum diameter of one of the bottles 13. The tube 15 is stretched and circumferentially applied over the outer surface of the tube 14 and the two center pairs of bottles 13 to make a stable package. In a reduction to practice of the embodiment of FIGS. 4 and 5, the bottles were seven fluid ounce beer bottles and with that bottle size the width of the inverted U-shaped handle portion of the tube 15 over the two center pairs of bottles was small enough to enable a person with an average sized hand to grasp the handle portion in a manner similar to that of the first embodiment for carrying of the package. Obviously the comfortable and convenient handle features for carrying the package are lost in a package such as shown in FIGS. 4 and 5 if the bottles are too large.

Figure 8:
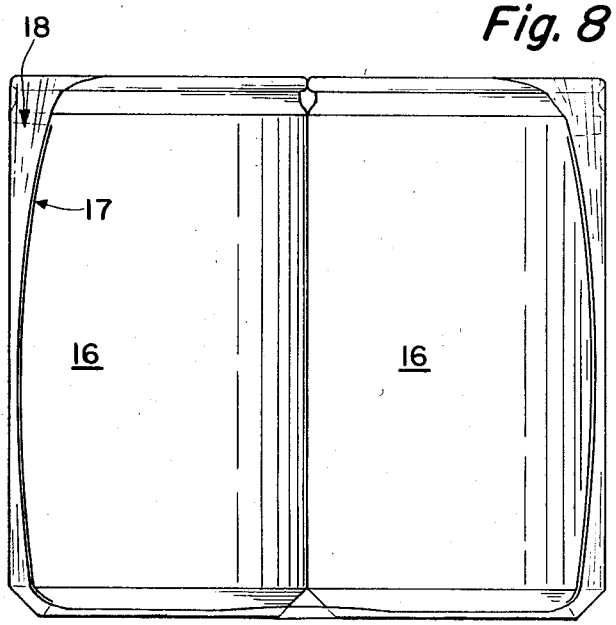
FIG. 8 is a cross sectional view of the structure of FIGS. 6 and 7 and taken substantially along the line 8—8 of FIG. 7.
Figure 6:
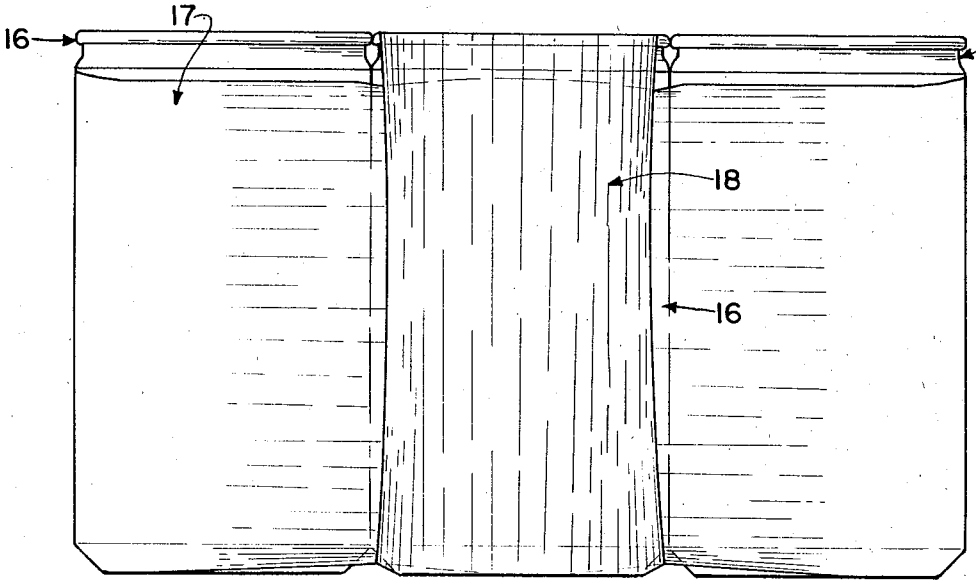
FIG. 6 is a side elevational view of another embodiment of the invention.
Figure 7:
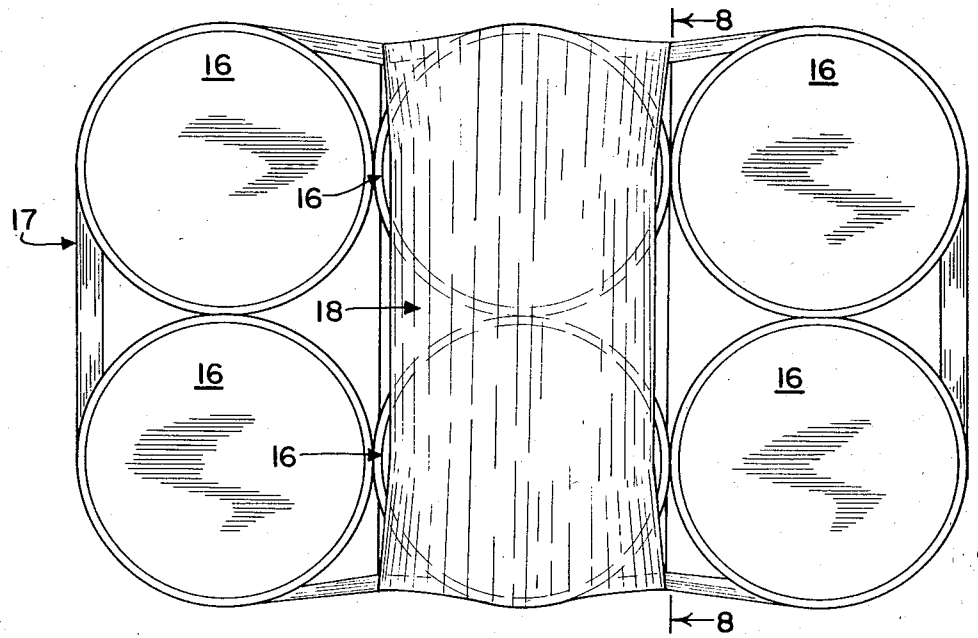
FIG. 7 is a top plan view of the structure shown in FIG. 6.

The embodiment of FIGS. 6–8 shows a package of six cans 16 made in accordance with the teachings of the invention. As shown, the cans 16 are of the two piece construction commonly used in twelve and sixteen fluid ounce sizes for the packaging of beer and soft drinks. In the embodiment of FIGS. 6–8, two tubes 17 and 18 are used to make the package. The tube 17 has an initial axial length of about the height of the body portion of the can 16. The body portion of the can 16 may be said to have a height which is the total height of the can minus the heights of the relatively thin lid and base sections.

The tube 18 has an initial axial length substantially equal to the maximum diameter of one of the cans 16.

The tube 17 is stretched and applied about the body portions of the six cans 16 arranged in the rectangular pattern shown.

The tube 18 is stretched and applied about the center pair of cans 16 and over the outer surface of the tube 17 to complete the package. Similarly to the first described embodiment, the tube 18 draws or indents the tube 17 on each side of the center pair of cans 16 to render the package stable. As shown in FIG. 8, the upper and lower edges of the tube 17 are indented to a substantially greater degree than the central portions of the tube 17.

In reductions to practice of the embodiment of FIGS. 6–8, it was found that apparently because of the high degree of stretch of the tube 18 and its association with the shape of the cans 16, the handle portion of the tube 18 between the cans of the center pair of cans does not assume an inverted U-shape.

Having described the invention, it is to be understood that changes can be made in the described embodiments by a person skilled in the art within the spirit and scope of the claims.

I claim:

1. A package of six or eight containers in which the containers have substantially cylindrical body portions between the upper and lower ends thereof, said containers arranged upright in a group with said body portions in side-by-side abutting relationships and in two parallel rows of substantially perpendicular ranks, a first tube of an elastic plastics material, said first tube having an initial axial length greater than one-half of the axial length of said body portions and an initial circumferential dimension substantially less than the circumferential dimension of said group measured in a horizontal direction about said body portions, said first tube being stretched and applied in a tensioned condition circumferentially of said group about said body portions, a second tube of an elastic plastics material, said second tube having an initial axial length substantially no greater than the distance between the opposed body portions of the end ranks of said containers in said group and an initial circumferential dimension substantially less than the circumferential dimension about a rank of said containers in said group taken in a flat plane perpendicular to the longitudinal direction of said rows and through the vertical central axes of said containers in said rank, and said second tube being stretched and applied in a tensioned condition circumferentially about the ranks of containers between the end ranks of containers of said group and over the outer surface of said first tube, and the tensioned condition of said second tube being sufficient to maintain at least the upper and lower edge portions of said first tube which are intersected by the edges of second tube indented.

2. In a package as defined in claim 1, wherein the tensile strength of said second tube is sufficient to enable said package to be carried by a person using the upper portion of said second tube which extends transversely of said package as a handle.

3. In a package as defined in claim 2, wherein the material thickness of said second tube is substantially greater than the material thickness of said first tube.

4. In a package as defined in claim 1, wherein said containers are bottles having neck portions tapering upwardly and inwardly from said body portions to a cap portion of substantially reduced diameter relative to said body portions and the tensioned condition of said second tube is sufficient to maintain the edge portions of the portion of said second tube which extends transversely of and over the upper ends of said containers directed in a generally downward direction.

5. A package of six bottles in which each of the bottles has a generally cylindrical body portion with a neck portion tapering upwardly and inwardly from the upper end of said body portion to a cap portion of substantially reduced diameter relative to said body portion, said six bottles arranged upright in a group with said body portions in side-by-side abutting relationships and in two parallel rows of three ranks substantially perpendicular to said rows, a first tube of an elastic plastics material, said first tube having an axial length greater than one-half of the axial length of said body portion of said bottles and less than the height of said bottles, said first tube having an initial circumferential dimension substantially less than the circumferential dimension of said group measured in a horizontal direction about said body portions of said bottles and greater than the circumferential dimension which would result in the elastic limits of the material of said first tube to be exceeded upon stretched circumferential application about said group of bottles, said first tube being stretched and applied in a tensioned condition circumferentially of said group about said body portions of said bottles, a second tube of an elastic plastics material, said second tube having an initial minimum axial length greater than the maximum diameter of said cap portion of said bottles and an initial maximum axial length substantially no greater than the maximum diameter of said body portion of said bottles, said second tube having an initial circumferential dimension substantially less than the circumferential dimension about a rank of said bottles measured in a flat plane through the vertical central axes of the bottles of said rank of bottles and greater than the circumferential dimension which would result in the elastic limits of the material of said second tube being exceeded upon stretched circumferential application about a rank of said bottles, and said second tube being stretched and applied in a tensioned condition circumferentially about the center rank of said three ranks of bottles and over the outer surface of said first tube, and the tensioned condition of said second tube being sufficient to maintain at least the upper and lower edges of said first tube which extend between said three ranks of bottles indented.

6. In a package as defined in claim 5, wherein the tensioned condition of said second tube is great enough to maintain the edge portions of said second tube which extend transversely of the upper portion of said package directed in a generally downward direction.

7. In a package as defined in claim 6, wherein the tensile strength of said second tube is sufficient to enable said package to be carried by a person grasping the portion of said second tube extending between the cap portions of said center rank of bottles as a handle.

8. A package of a plurality of pairs of generally cylindrical containers in which the number of pairs is less than five and greater than two, said plurality of pairs of containers being held upright together in a row with each pair arranged transversely of said row by two elastic plastics material tubes applied with the axes of said tubes at right angles to each other and in a stretched tensioned condition about said plurality of pairs of containers, one of said tubes arranged about said plurality of pairs of containers with the axis thereof parallel to the longitudinal axes of said containers, the other of said tubes applied over the outer surface of said one of said tubes centrally of said row of containers and having a width substantially equal to the length of said row minus twice the maximum diameter of said containers and a width in the portion thereof extending over the upper side of said containers enabling said portion to be grasped as a handle by a person carrying said package, and said other of said tubes being in a sufficiently stretched tensioned condition to maintain at least the upper and lower edge portions of said one tube which are intersected by said other tube indented.

9. A pair of tubes for binding a plurality of pairs of generally cylindrical containers together in a package with said pairs of containers arranged upright in a row with each pair arranged transversely of said row, said pair of tubes formed from elastic plastics materials, one of said tubes having an axial length greater than one-half of the height of said containers and less than the height of said containers, said one of said tubes having a circumferential dimension substantially less than the maximum circumferential dimension of said pairs of containers measured in a flat plane perpendicular to the longitudinal axes of said containers and greater than a circumferential dimension which would result in the elastic limits of the material of said one of said tubes being exceeded upon stretched circumferential application about said pairs of containers in a direction in which the axis of said one of said tubes is parallel to the longitudinal axes of said containers, said other of said tubes having an axial length substantially equal to the maximum length of said row minus twice the maximum transverse dimension of one of said containers, and said other of said tubes having a circumferential dimension less than the circumferential dimension about one of said pairs of containers measured in a flat plane including the longitudinal axes of said one of said pairs of containers and a circumferential dimension greater than a circumferential dimension which would result in the elastic limits of the material of said other of said tubes being exceeded upon stretched circumferential application about one of said pairs of containers in a direction of application placing the axis of said other of said tubes perpendicular to a flat plane including the longitudinal axes of said one of said pairs of containers, and said circumferential dimension of said other of said tubes being sufficiently small enough to cause at least the upper and lower edge portions of said one of said tubes which are intersected by said other of said tubes to be indented when said one of said tubes is applied about said container with the axis of said one of said tubes disposed vertically and said other of said tubes disposed over said one of said tubes with the axis of said other of said tubes disposed horizontally and longitudinally of said row.

10. A pair of tubes as defined in claim 9, and said other of said tubes having a tensile strength sufficient to enable said package to be carried upon grasping of said other of said tubes by a person as a handle.

11. The method for making a multipackage of a plurality of pairs of containers having generally cylindrical body portions in which the number of pairs is less than five and greater than two, comprising the steps of:

arranging said pairs of containers in the pattern of a row with each pair aligned transversely of said row and with the adjacent body portions of said containers in an abutting relationship, providing a first band of a circumferentially continuous elastic plastics film material of an initial length sufficient to cover substantial vertical portions of said containers and of an initial circumferential dimension substantially less than the maximum circumferential dimension measured horizontally circumferentially about said substantial vertical portions of said body portions of said containers as arranged in the first step and greater than a circumferential dimension which will result in the elastic limits of said first band being exceeded upon stretched application of said first band circumferentially about said substantial vertical portions of said containers when arranged as in said first step, stretching said first band circumferentially sufficiently and in a complementary pattern of said pattern of said first step to enable said first band to be telescopically applied about said substantial vertical portions of said containers in said pattern of said first step and so applying said first band, providing a second band of a circumferentially continuous elastic plastics film material of an initial axial length sufficient to substantially span the horizontal distance between the end pairs of said containers in said row and of an initial circumferential dimension substantially less than the circumferential dimension about one pair of said containers measured in a flat plane including the longitudinal center axes of said one pair of containers and greater than a circumferential dimension which will result in the elastic limits of said second band being exceeded upon stretched application of said second band about said row of containers with the axis of said second band disposed longitudinally of said row, stretching said second band circumferentially sufficiently and in a complementarily encompassing pattern of the pattern traced by the surfaces of said one pair of containers in a flat plane including the longitudinal center axes of said one pair of containers, and applying said stretched second band about said row of containers with the axis of said second band disposed longitudinally of said row and with said second band over the outer surface of said first band and with said second band substantially centered longitudinally of said row and with the edge portions of said second band disposed on said first band sufficiently inwardly relative to the ends of said row of containers to indent at least the upper and lower edge portions of said first band.

* * * * *